US005374168A

United States Patent [19]

Kozawa et al.

[11] Patent Number: 5,374,168

[45] Date of Patent: Dec. 20, 1994

[54] RECIPROCATING PISTON FLUID PUMP

[75] Inventors: Tadashi Kozawa, Anjo; Hiroshi Okano, Aichi; Hideo Nagayama, Ichinomiya; Kazuya Andoh, Aichi, all of Japan

[73] Assignees: Aisan Kogyo Kabushiki Kaisha, Ohbu; Toyota Jodosha Kabushiki Kaisha, Toyota, both of Japan

[21] Appl. No.: 135,985

[22] Filed: Oct. 14, 1993

[51] Int. Cl.[5] ..... F04B 21/02

[52] U.S. Cl. ..... 417/471; 417/534; 417/502; 417/503; 277/165; 277/215

[58] Field of Search ..... 417/471, 415, 502, 503, 417/534, 535; 277/35, 165, 215

[56] References Cited

U.S. PATENT DOCUMENTS

| | | | |
|---|---|---|---|
| 351,665 | 10/1886 | Snyder | 417/534 |
| 1,679,132 | 7/1928 | Holdsworth | 417/534 |
| 2,845,033 | 7/1958 | Wright | 417/535 |
| 3,256,824 | 6/1966 | Sebardt | 417/385 |
| 3,394,941 | 7/1968 | Traub | 277/165 |
| 3,860,250 | 1/1975 | Lundquist | 277/165 |
| 4,137,020 | 1/1979 | Ito et al. | 417/534 |
| 4,151,999 | 5/1979 | Ringel et al. | 277/165 |
| 4,179,131 | 12/1979 | Nussbaumer | 277/165 |
| 4,286,932 | 9/1981 | Nagano et al. | 417/534 |
| 4,911,455 | 3/1990 | Edlund | 277/165 |

FOREIGN PATENT DOCUMENTS

| | | |
|---|---|---|
| 523164 | 4/1931 | Germany . |
| 1114273 | 9/1961 | Germany . |
| 1123347 | 2/1962 | Germany . |
| 1169970 | 5/1964 | Germany . |
| 1252064 | 4/1968 | Germany . |
| 8001656 | 11/1981 | Germany . |
| 3111143 | 9/1982 | Germany . |
| 3339872 | 5/1985 | Germany . |
| 55-123384 | 9/1980 | Japan . |
| 58-189380 | 12/1983 | Japan . |
| 519576 | 3/1993 | Japan . |
| 5149252 | 6/1993 | Japan . |

*Primary Examiner*—Richard A. Bertsch
*Assistant Examiner*—Peter Korytnyk
*Attorney, Agent, or Firm*—Cushman, Darby & Cushman

[57] ABSTRACT

A reciprocating piston fluid pump according to the present invention comprising: a pump driving section including a cam operated by an engine and a roller driven by the cam, the roller being provided at a lower end of a piston rod; a piston provided at an upper portion of the piston rod; a pump chamber housing the piston and divided into a piston upper chamber and a piston lower chamber by the piston, the pump chamber including a bearing opening at a central portion of the piston lower chamber, through which the piston rod extends; a rod seal retainer portion provided between the piston rod and the bearing opening of the pump chamber; a spring for urging the piston rod downwardly; oil passage means for communicating the pump upper chamber or the pump lower chamber with the bearing opening, the oil passage means being provided on an oil seal member or the piston rod; oil supply means for supplying lubricating oil to the pump driving section or the bearing opening; and at least one communication hole provided between the pump driving section and the oil supply means.

10 Claims, 9 Drawing Sheets

RECIPROCATING PISTON FLUID PUMP

BACKGROUND OF THE INVENTION

1. Industrial Field of the Invention

The present invention relates to a reciprocating piston fluid pump installed in a vehicle and driven by an engine of the vehicle to fulfill a function as a vacuum pump or the like.

2. Description of Related Art

As a representative of such a pump, a vacuum pump is used for a brake booster of a diesel engine.

This vacuum pump includes a pump upper chamber and a pump lower chamber defined above and below an actuating piston in the pump chamber. A seal member fitted in an annular groove formed on an outer periphery of the piston acts as a slidable portion between the piston and a cylinder. A rod of the piston is driven by a cam which is moved by the engine to thereby reciprocatingly move the actuating Distort vertically, so that the pump is driven by the vehicle engine.

The piston is formed as a disk plate having a thickness enough to retain a seal member which is fitted in a groove formed on the outer periphery. The thickness of the piston is thus uniform in the radial direction from its outer periphery to its central portion, so that the weight of the piston is inevitably large. For these reasons, a compression spring which can exert a large urging force is required. The compression spring is provided on the piston rod to press the rod against the cam, so that the piston rod can be operated following the rotation of the cam.

The rod is designed to vertically slide within a rod seal. A small amount of oil mist is sucked into the pump lower chamber through a minute gap between the rod and the rod seal, the gap being opened to the interior of the engine.

In the above-described conventional pump, only a small amount of oil mist is sucked into the pump lower chamber through the minute gap between the rod and the rod seal. For these reasons, when the pump is driven in a high- temperature atmosphere and the air introduced in the pump chamber is evacuated, the small amount of oil stored in the pump chamber is taken away during the evacuation. As a result, the slidable portion with respect to the piston cannot be sufficiently lubricated, so that wear of the piston ring and seizure of the cylinder occur.

Due to surface roughness of the sliding surfaces of the piston ring and the cylinder and the wear of the piston ring, the sealing ability at the piston slidable portion is deteriorated, which results in deterioration of a pumping performance.

Further, an amount of generation of heat is increased because of the surface roughness of the sliding surface, so that a volume of an O-ring is expanded. Because contact pressure between surfaces of the cylinder and the O-ring is increased due to the volume expansion of the O-ring, the resistance between the cylinder and the O-ring is increased more when they slide against each other. Such vicious cycle may be caused in the conventional pump.

Because the piston slidable portion is unusually abraded due to the increase of the sliding resistance between the piston and the cylinder and because the load of the compression spring is large, force applied to contact portions between the rod and the cam is increased so that the contact portions between the rod and the cam are abnormally abraded.

SUMMARY OF THE INVENTION

In view of the above problems, a first object of the invention is to provide a reciprocating piston fluid pump in which a sufficient amount of lubricating oil is supplied to an actuating piston slidable portion to thereby prevent deterioration of a pumping performance and abnormal wear of the mechanism which are problems of the conventional pump.

In addition to the first object, the invention also aims to lessen force applied to a contact portion between a piston rod and a cam by lightening a mass of a piston and acting force of a compression spring, thereby preventing abnormal wear of the mechanism and maintaining a stable pumping performance over along period of time.

To achieve the above object, a reciprocating piston fluid pump according to the invention comprises: a pump driving section including a cam operated by an engine and a roller driven by the cam, the roller being provided at a lower end of a piston rod; a piston provided at an upper portion of the piston rod; a pump chamber housing the piston and divided into a piston upper chamber and a piston lower chamber by the piston, the pump chamber including a bearing opening at a central portion of the piston lower chamber, through which the piston rod extends; a rod seal retainer portion provided between the piston rod and the bearing opening of the pump chamber; a spring for urging the piston rod downwardly; oil passage means for communicating one of the pump upper chamber and the pump lower chamber with the bearing opening around the piston rod; oil supply means for supplying lubricating oil to the pump driving section; and at least one communication hole provided between the pump driving section and the oil supply means.

With such structure, a roller provided at a lower end of the piston rod for engagement with the cam in place of the rod lessens force applied to contact portions between the rod and the cam. The lubricating oil supplied to the pump driving section by the lubricating oil supply means is introduced through the communication holes to the bearing opening. The lubricating oil further flows through the oil passages into one pump chamber, so as to lubricate the piston slidable portion.

Also, to achieve the above object, a reciprocating piston fluid pump according to the invention comprises: a pump driving section including a cam operated by an engine and a roller driven by the cam, the roller being provided at a lower end of a piston rod; a piston provided at an upper portion of the piston rod; a pump chamber housing the piston and divided into a piston upper chamber and a piston lower chamber by the piston, the pump chamber including a bearing opening at a central portion of the piston lower chamber, through which the piston rod extends; a rod seal retainer portion provided between the piston rod and the bearing opening of the pump chamber; a spring for urging the piston rod downwardly; oil passage means for communicating one of the pump upper chamber and the pump lower chamber with the bearing opening around the piston rod; and oil supply means for directly supplying lubricating oil to the bearing opening.

Further, to attain the object, a reciprocating piston fluid pump according to the invention comprises: a pump driving section including a cam operated by an engine and a roller driven by the cam, the roller being provided at a lower end of a piston rod; a piston provided at an upper portion of the piston rod; a pump chamber housing the piston and divided into a piston upper chamber and a piston lower chamber by the piston, the pump chamber including a bearing opening at a central portion of the piston lower chamber, through which the piston rod extends; a rod seal retainer portion provided between the piston rod and the bearing opening of the pump chamber; a spring for urging the piston rod downwardly; oil passage means for communicating one of the pump upper chamber and the pump lower chamber with the bearing opening around the piston rod; oil supply means for supplying lubricating oil to the bearing opening; and at least one communication hole provided between the bearing opening and the oil supply means.

In the above structure, the reciprocating piston fluid pump is characterized in that a central portion of a lower surface of the piston is concaved upwardly, a central portion of a bottom of the pump lower chamber is convex upwardly, and the rod seal retainer portion is provided at the central portion of the convex portion.

In such structure, the lubricating oil from the oil supply means is directly supplied to the bearing opening through the communication holes. The lubricating oil is further introduced from the oil passages into the pump chamber, so as to lubricate the piston slidable portion.

DESCRIPTION OF THE PREFERRED EMBODIMENTS

Figure 1:
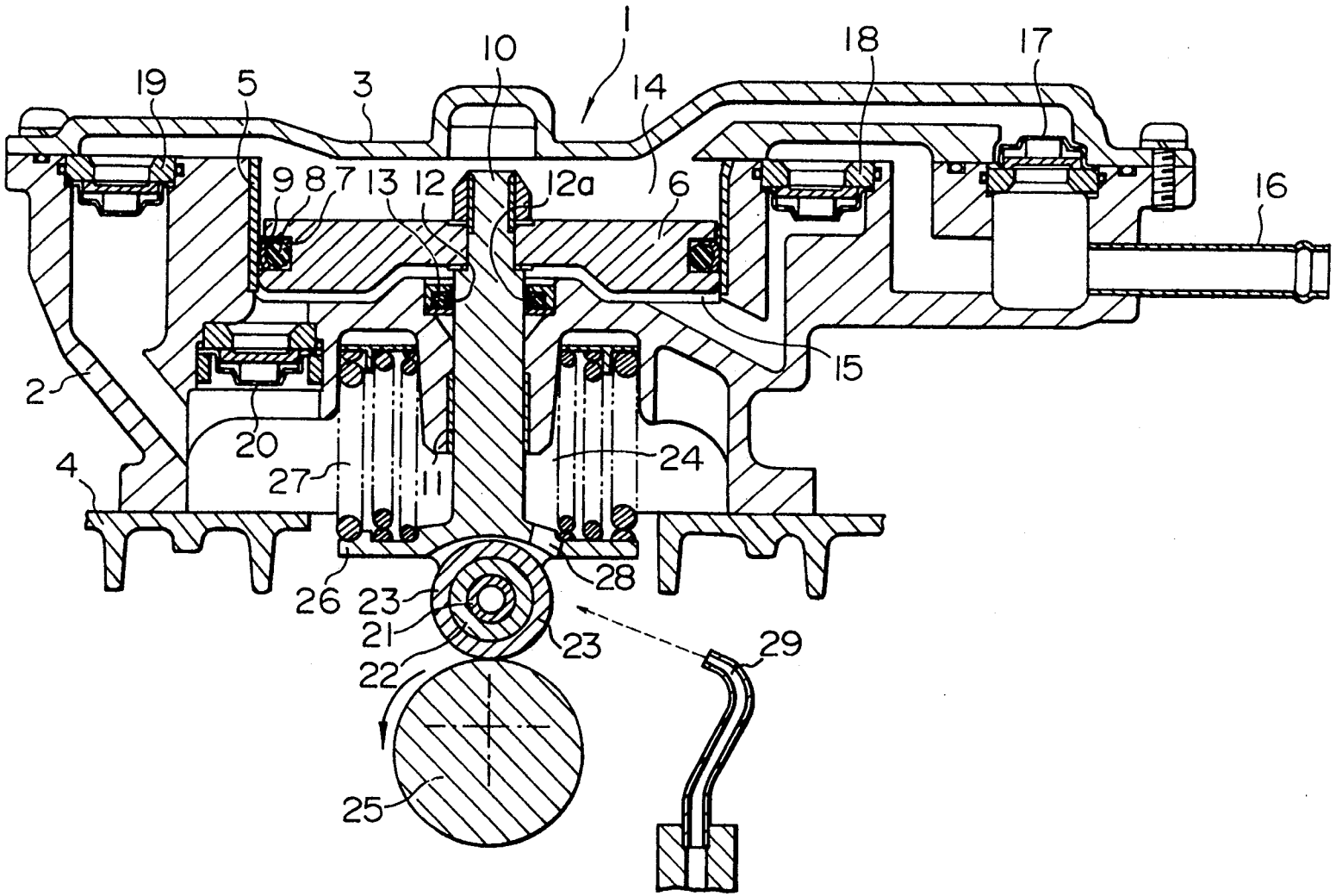
FIG. 1 is a longitudinally cross-sectional view of a first embodiment according to the present invention.
Figure 2:
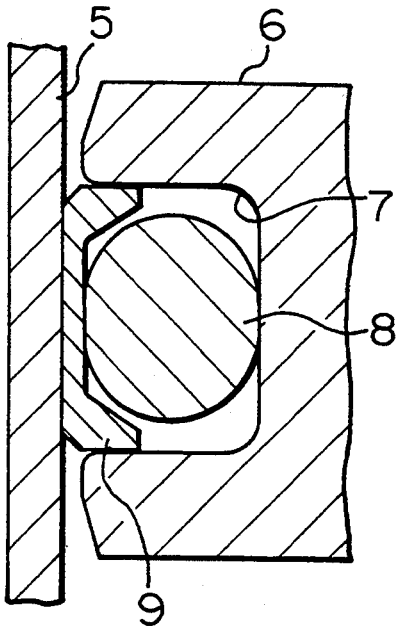
FIG. 2 is a partially enlarged view of FIG. 1.

Referring to FIGS. 1 to 4 illustrating a first embodiment according to the invention, reference numeral 1 designates a vacuum pump which includes a lower casing 2 and an upper casing 3. A bottom portion of the lower casing 2 is secured to a cylinder head cover 4 of an engine.

A cylinder 5 is securely attached to the lower casing 2, and a piston 6 is vertically movable within the cylinder 5. An O-ring 8 and a Teflon piston ring 9 are fitted in an annular groove 7 provided on an outer periphery of the piston 6. The O-ring 8 presses the piston ring 9 against an inner peripheral surface of the cylinder 5 by its elasticity and absorbs a dimensional change of the piston ring 9 caused by a change of temperature.

A central portion of a lower surface of the piston 6 is concaved upwardly. A thickness of the central portion of the piston is thus minimized while the piston has a requisite strength, so that weight of the piston 6 is decreased.

A piston rod 10 is vertically slidably supported by a bearing 11 provided in the lower casing 2. An upper end of the piston rod 10 is fixed to the center of the piston 6.

Figure 4:
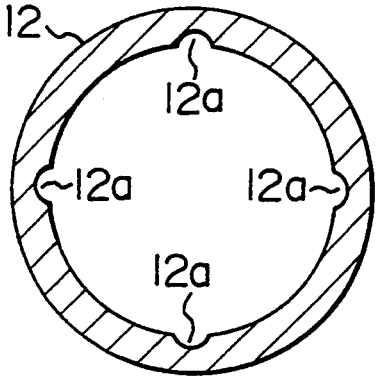
FIG. 4 is a horizontally cross-sectional view of a seal ring of FIG. 3.
Figure 3:
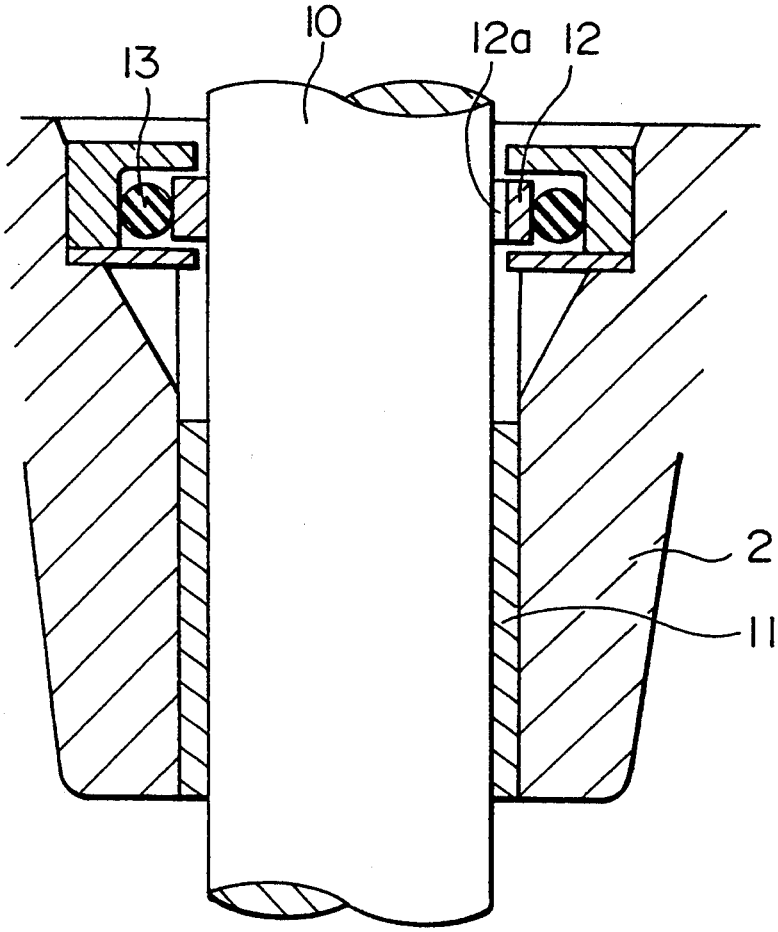
FIG. 3 is an enlarged view of an essential portion of FIG. 1.

A Teflon seal ring 12 to be fitted on the rod 10 is provided in the lower casing 2. As illustrated in FIGS. 3 and 4 on an enlarged scale, oil passages **12*a* are provided at four positions on an outer periphery of the seal ring 12**.

An O-ring 13 is provided around the seal ring 12 in order to press the seal ring 12 against the outer periphery of the piston rod 10 by its elasticity as well as absorb a dimensional change of the seal ring 12 due to a change of temperature.

Reference numerals 14 and 15 designate a pump upper chamber and a pump lower chamber defined above and below the piston 6 in the pump chamber, respectively. A pipe 16 is secured to the lower casing 2, which pipe is communicated with a brake booster (not shown).

A portion of the lower casing 2 which forms a central portion of a bottom surface of the pump lower chamber 15 is convex upwardly. A rod seal retainer portion for holding the seal members such as the seal ring 12 and the O-ring 13 is formed at the center of the convex portion.

Reference numerals 17 and 18 denote inlet valves provided between the pipe 16 and the pump upper chamber 14 and between the pipe 16 and the pump lower chamber 15, respectively. The pump upper chamber 14 and the pump lower chamber 15 are communicated with a space within the head cover 4 via outlet valves 19 and 20.

A pin 21 is secured to a lower end portion of the piston rod 10. A small-diameter roller 22 is rotatably fitted on the pin 21, and a large-diameter roller 23 is fitted on an outer periphery of the small-diameter roller 22. The roller 23 is in press-contact with a cam 25 formed on a cam shaft of the engine.

A flange 26 is formed in the vicinity of a lower end of the piston rod 10, and a compression spring 27 is provided between the flange 26 and the lower casing 2. The compression spring 27 presses the piston rod 10 downwardly so as to bring the roller 23 into press-contact with the cam 25. The load of the compression spring 27 is reduced in the function of the reduction of the weight of the piston 6.

The roller 23 constructed in the above-mentioned manner acts as a pump driving member which follows the cam 25.

The bearing 11 has an opening 24 located at its lower portion. Communication holes 28 are formed through the flange 26. An oil nozzle 29 acts as means for supplying lubricating oil and feeds the lubricating oil to an outer peripheral surface of the roller 23 which is the pump driving member.

The lubricating oil supplied to the outer peripheral surface of the roller 23 collides against the outer peripheral surface of the roller 23 and splashes. The splashed oil is introduced through the communication holes 28 to the bearing opening 24. The lubricating oil further flows passing through a gap between the bearing 11 and the piston rod 10 so as to be sucked into the pump lower chamber 15 via the oil passages 12*a*.

In the above-described embodiment, when the cam 25 is rotated by the engine, the cam 25 drives the roller 23 which is the pump driving member. The roller 23 thus reciprocatingly moves the piston rod 10 and the piston 6 vertically.

When the piston 6 moves upwardly, air within the pump upper chamber 14 is discharged into the space within the cylinder head cover 4 through the outlet valve 19. The air is then sucked from the brake booster (not shown) through the pipe 16 and the inlet valve 18 into the pump lower chamber 15. At the same time, the lubricating oil which has contacted with the outer peripheral surface of the roller 23 and splashed, is introduced into the pump lower chamber 15 through the communication holes 28, the bearing opening 24, the gap between the bearing 11 and the piston rod 10, and the oil passages 12*a* by the negative pressure of the pump lower chamber 15, then being dispersed within the pump lower chamber 15.

By repetition of vertically reciprocating movement of the piston, a sufficient amount of the lubricating oil flows into the pump lower chamber 15 and adheres to sliding surfaces of the piston ring 9 and the cylinder 5, so that a good sliding condition between them can be maintained.

When the piston 6 moves downwardly, the air within the pump lower chamber 15 is discharged into the space within the cylinder head cover 4 through the outlet valve 20. The air is then sucked from the brake booster through the pipe 16 and the inlet valve 17 into the pump upper chamber 14. The lubricating oil adhering in the vicinity of the cylinder 5 and the piston ring 9 on a side of the pump lower chamber 15 is introduced into the pump upper chamber 14 from the pump lower chamber 15 by the negative pressure of the pump upper chamber 14 and dispersed within the pump upper chamber 14.

By repetition of vertically reciprocating movement of the piston 6, the lubricating oil further flows into the pump upper chamber 14 and adheres to the sliding surfaces of the piston ring 9 and the cylinder 5, so that a good sliding condition can be maintained. Thus, the lubrication of the piston sliding surfaces is satisfactorily performed.

The lubricating oil flowing through the oil passages 12*a* adheres to inner walls of the oil passages 12*a* communicating with the pump lower chamber 15, which lubricating oil prevents the air from being unnecessarily sucked into the pump lower chamber 15 through the oil passages 12*a*.

Although the oil nozzle 29 is provided as a source for supplying oil in the above embodiment, an oil reservoir may be provided at a lower portion of the cam 25 in place of the oil nozzle 29 so that the lubricating oil in the oil reservoir is dispersed by the rotating cam 25 so as to be fed toward the bearing opening 24 through the communication holes 28.

Figure 5:
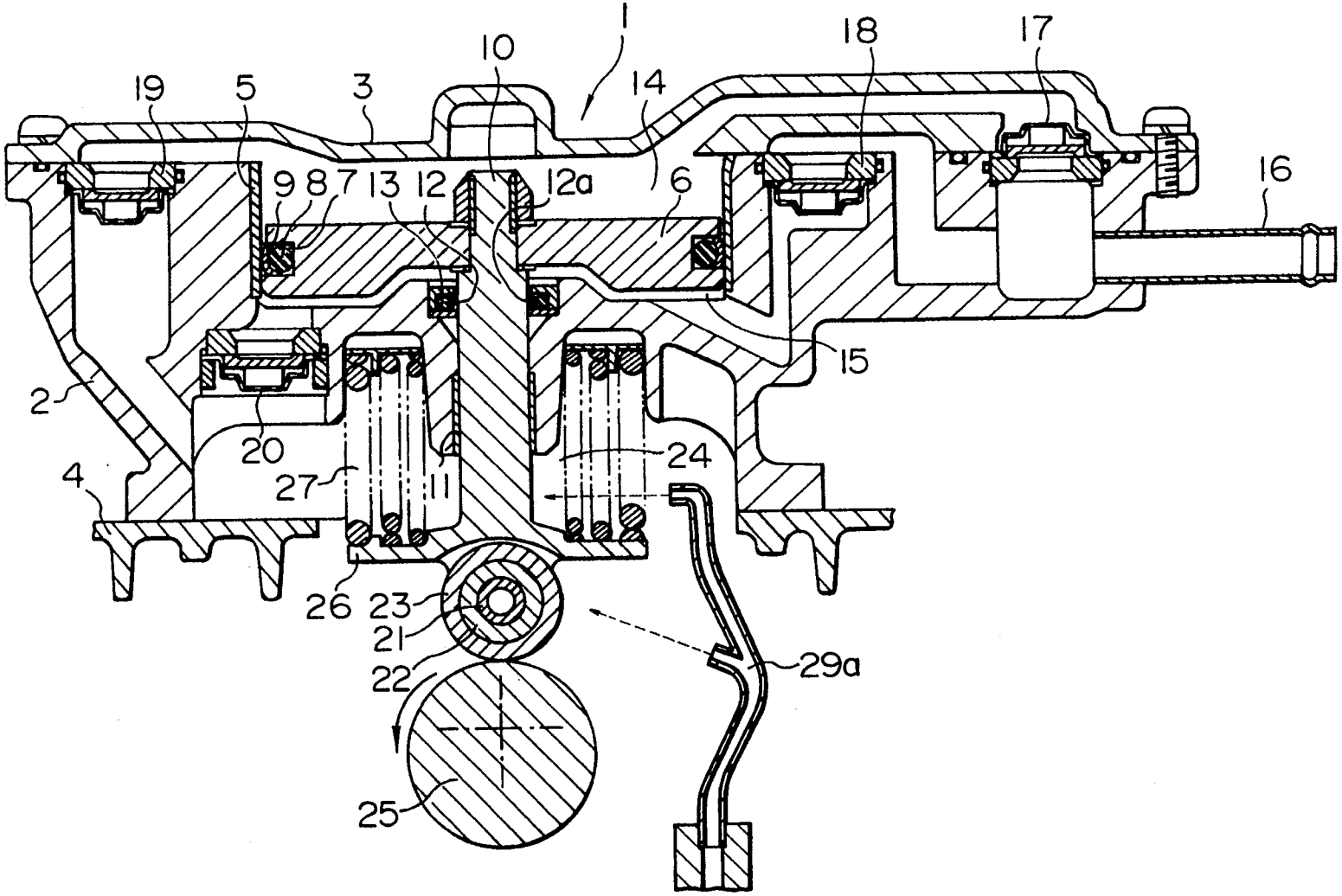
FIG. 5 is a longitudinally cross-sectional view of a second embodiment according to the invention.

A second embodiment illustrated in FIG. 5 is partially different from the first embodiment shown in FIGS. 1 to 4. Only different portions of the second embodiment from the first embodiment will now be described.

In the second embodiment, a flange 26 is not provided with a communication hole. Oil nozzle means 29*a* as lubricating oil supply means has two ports. The lubricating oil is delivered to an outer peripheral surface of a roller 23 from one port of the oil nozzle means 29*a* and the lubricating oil is directly supplied to a bearing opening 24 through the other port of the oil nozzle means 29*a*.

Figure 6:
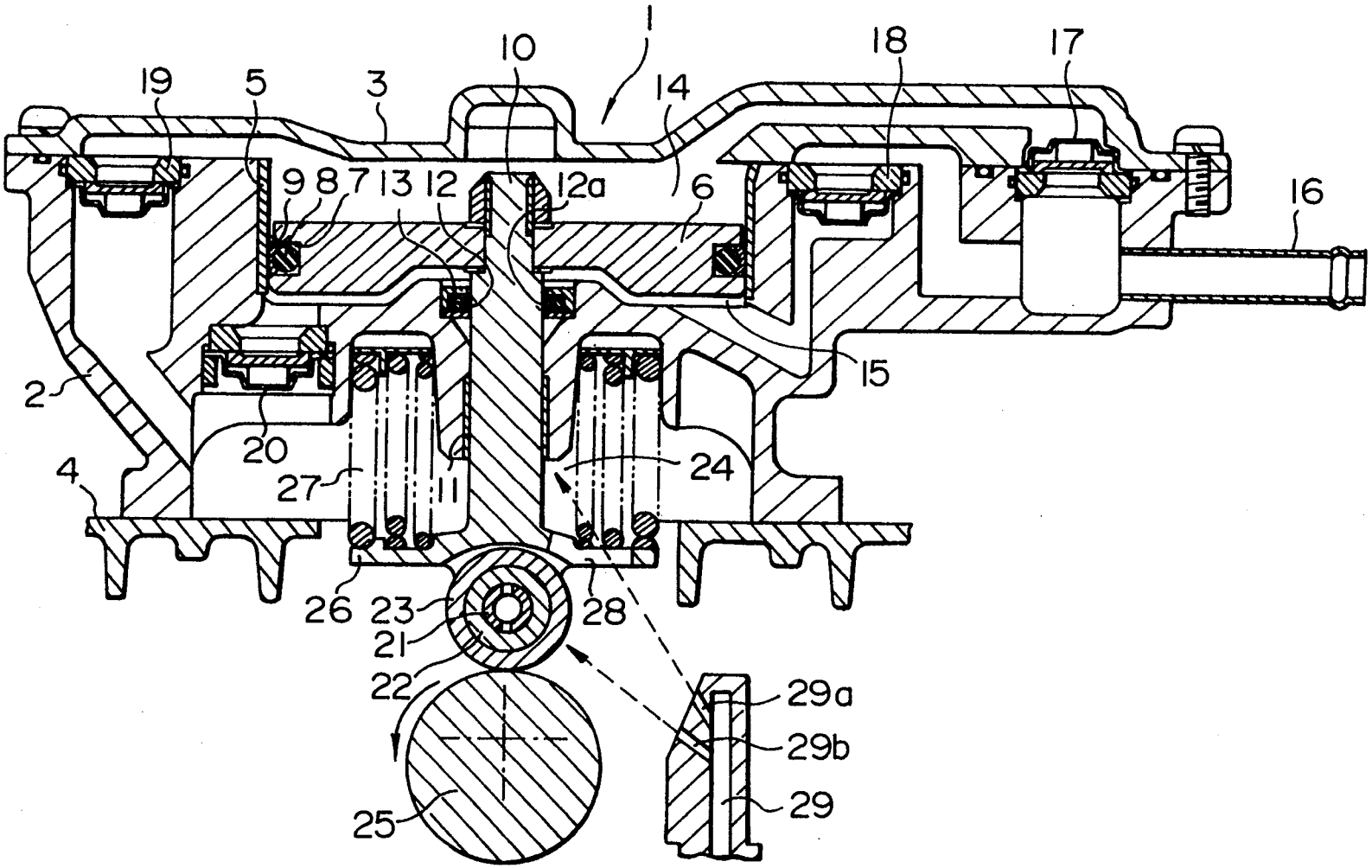
FIG. 6 is a longitudinally cross-sectional view of a third embodiment according to the invention.

A third embodiment illustrated in FIG. 6 is partially different from the first embodiment shown in FIGS. 1 to 4. Only different portions of the third embodiment from the first embodiment will now be described.

In the third embodiment, a bearing opening 24 locates at a lower portion of a bearing 11, and at least one communication hole 28 is provided in a flange 26. Oil supply means 29 include an oil nozzle 29*a* for supplying lubricating oil through the communication hole 28 to the bearing opening 24 and an oil nozzle 29*b* for supplying the lubricating oil to an outer peripheral surface of a roller 23 which is a pump driving member.

The lubricating oil sprayed from the oil nozzle 29*a* as the oil supply means passes through the communication hole 28 of the flange 26 and it is delivered to the bearing opening 24. The lubricating oil further passes through a gap between the bearing 11 and a piston rod 10 to be sucked into a pump lower chamber 15 via oil passages 12*a*.

In the third embodiment, when a cam 25 is rotated by an engine, the cam 25 drives the roller 23 which is the pump drive member. The roller 23 thus reciprocatingly moves the piston rod 10 and a piston 6 vertically.

When the piston 6 moves upwardly, air within a pump upper chamber 14 is discharged into a space within a cylinder head cover 4 through an outlet valve 19. The air is then sucked from a brake booster (not shown) through a pipe 16 and an inlet valve 18 into the pump lower chamber 15. At the same time, the lubricating oil supplied to the bearing opening 24 through the communication hole 28 from the oil nozzle 29*a* of the oil supply means, is introduced into the pump lower chamber 15 via the gap between the bearing 11 and the piston rod 10 and the oil passages 12*a* by the negative pressure of the pump lower chamber 15, then being dispersed within the pump lower chamber 15.

By repetition of vertically reciprocating movement of the piston, a sufficient amount of the lubricating oil flows into the pump lower chamber 15 and adheres to sliding surfaces of a piston ring 9 and a cylinder 5, so that a good sliding condition between them can be maintained.

When the piston 6 moves downwardly, the air within the pump lower chamber 15 is discharged into the space within the cylinder head cover 4 through an outlet valve 20. The air is then sucked from the brake booster through the pipe 16 and an inlet valve 17 into the pump upper chamber 14. The lubricating oil adhering in the vicinity of the cylinder 5 and the piston ring 9 on a side of the pump lower chamber 15 is introduced into the pump upper chamber 14 from the pump lower chamber 15 by the negative pressure of the pump upper chamber 14 and dispersed within the pump upper chamber 14.

By repetition of vertically reciprocating movement of the piston 6, the lubricating oil further flows into the pump upper chamber 14 and adheres to the sliding surfaces of the piston ring 9 and the cylinder 5, so that a good sliding condition can be maintained. Thus, the lubrication of the piston sliding surfaces is satisfactorily performed.

The lubricating oil flowing through the oil passages 12*a* adheres to inner walls of the oil passages 12*a* communicating with the pump lower chamber 15, which lubricating oil prevents the air from being unnecessarily sucked into the pump lower chamber 15 through the oil passages 12*a*.

Sludge or the like sticking to a proximal end portion of the piston rod at the flange 26 spontaneously drops to be discharged to the outside from the communication hole 28 together with the lubricating oil. Accordingly, the communication hole 28 has an effect of discharging the sludge or the like in the oil as well as an effect of maintaining a stable pumping performance over a long period of time due to the reduction of wear of the bearing slidable portions and the piston slidable portions.

In the above-described third embodiment, the oil supply means including the two oil nozzles 29*a* and 29*b* are provided as the oil supply source. Alternatively, one oil nozzle 29*b* may be omitted so that the lubricating oil sprayed around the bearing opening portion 24 from the oil nozzle 29*a* spontaneously drops through the communication hole 28 to the pump driving member, for lubricating the roller 23.

Figure 7:
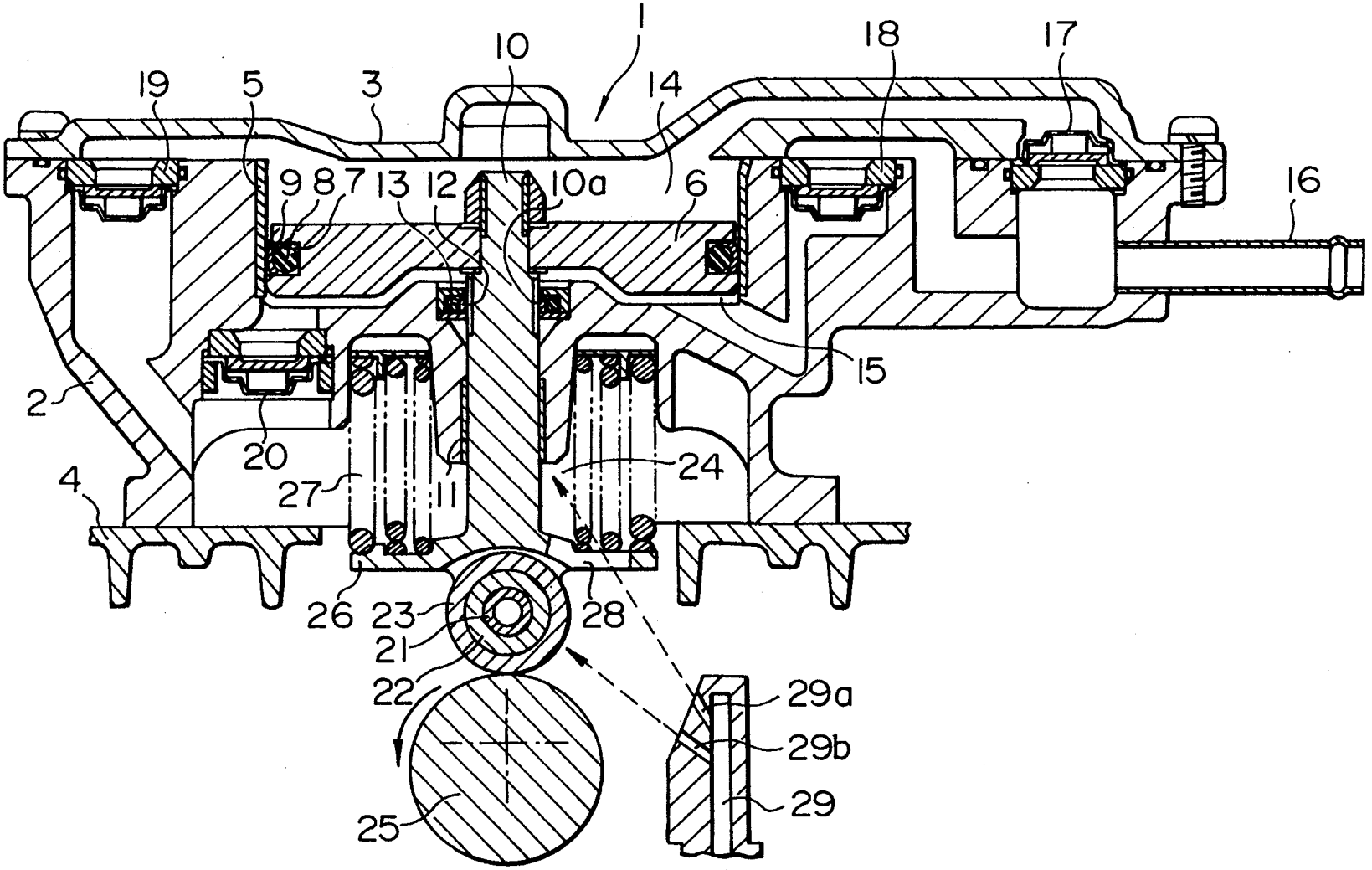
FIG. 7 is a longitudinally cross-sectional view of a fourth embodiment according to the invention.
Figure 8:
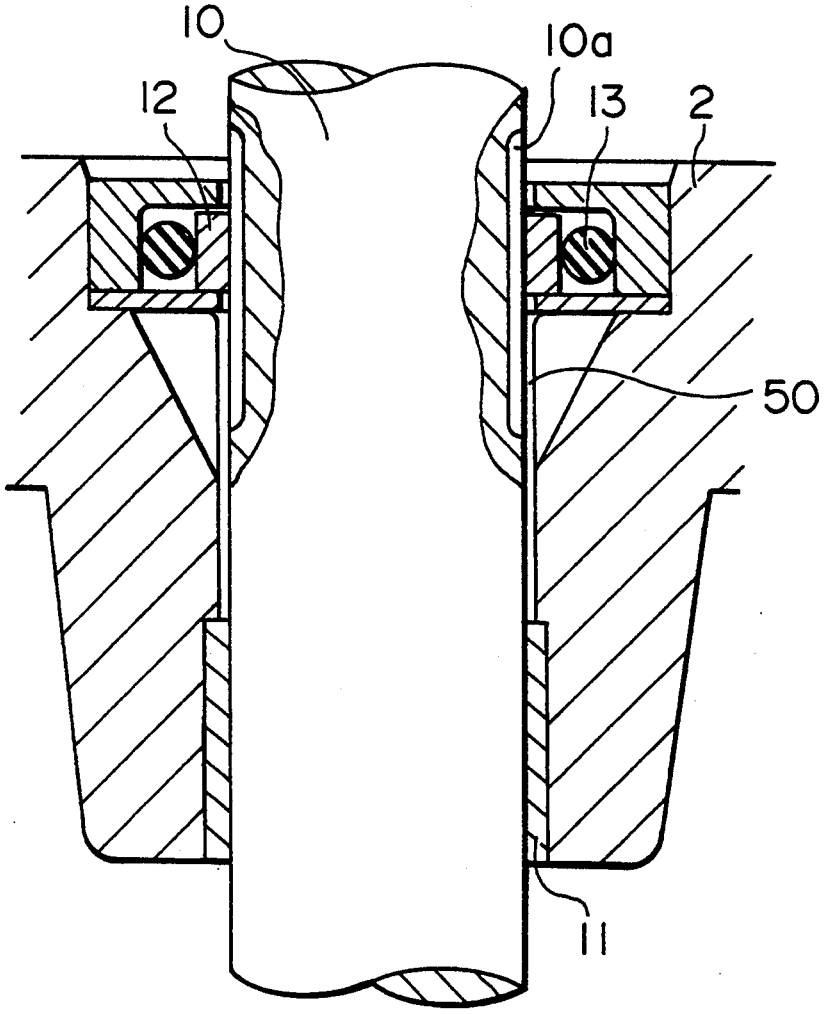
FIG. 8 is an enlarged view of an essential portion of FIG. 7.
Figure 9:
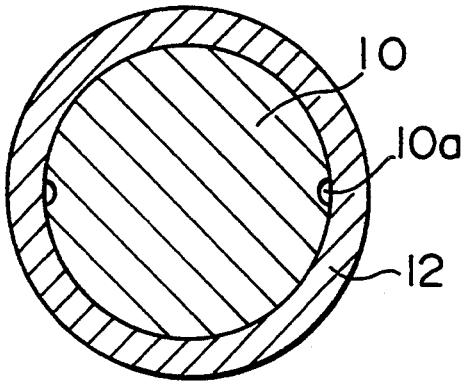
FIG. 9 is a horizontally cross-sectional view of a piston rod and a seal ring of FIG. 8.

A fourth embodiment of the invention shown in FIGS. 7 to 9 is partially different from the third embodiment of FIG. 6. Only different portions of the fourth embodiment from the third embodiment will be described below.

The fourth embodiment is characterized in that oil passages for communicating a pump lower chamber 15 and a bearing opening 24 with each other are provided on a piston rod 10.

In the fourth embodiment, a Teflon seal ring 12 to be fitted on the rod 10 is provided in a lower casing 2. As illustrated in FIGS. 8 and 9 on an enlarged scale, the oil passages 10*a* are formed at two positions on an outer periphery of the rod 10.

The oil passages 10*a* are formed in shapes of elongated grooves extending beyond upper and lower end portions of the seal ring 12 in an entire stroke of the piston 6. No squeeze portion is formed in the thus-constructed oil passages between the piston rod 10 and the seal ring 12 when the piston rod is at any positions so that they are hardly choked with sludge or the like.

An annular gap 50 is defined between the outer periphery of the piston rod 10 and the lower casing 2, which annular gap facilitates entrance of lubricating oil which has passed through the bearing 11, into the oil passages 10*a*.

An O-ring 13 is provided around the seal ring 12 in order to press the seal ring 12 against the outer periphery of the piston rod 10 by its elasticity as well as to absorb a dimensional change of the seal ring 12 due to a change of temperature.

The lubricating oil sprayed from an oil nozzle 29*a* as oil supply means passes through a communication hole 28 of a flange 26 and it is delivered to the bearing opening 24. The lubricating oil further passes through a gap between the bearing 11 and the piston rod 10 to be sucked into the pump lower chamber 15 via the oil passages 10*a*.

In the fourth embodiment, when a cam 25 is rotated by an engine, the cam 25 drives a roller 23 which is a pump driving member. The roller 23 thus reciprocatingly moves the piston rod 10 and the piston 6 vertically.

When the piston 6 moves upwardly, air within a pump upper chamber 14 is discharged into a space within a cylinder head cover 4 through an outlet valve 19. The air is then sucked from a brake booster (not shown) through a pipe 16 and an inlet valve 18 into the pump lower chamber 15. At the same time, the lubricating oil supplied to the bearing opening 24 through the communication hole 28 from the oil nozzle 29*a* of the oil supply means, is introduced into the pump lower chamber 15 via the gap between the bearing 11 and the piston rod 10 and the oil passages 10*a* by the negative pressure of the pump lower chamber 15, then being dispersed within the pump lower chamber 15.

By repetition of vertically reciprocating movement of the piston, a sufficient amount of the lubricating oil flows into the pump lower chamber 15 and adheres to sliding surfaces of a piston ring 9 and a cylinder 5, so that a good sliding condition between them can be maintained.

Similarly to the above-described embodiments, the lubrication of the piston sliding surfaces is satisfactorily performed.

The lubricating oil flowing through the oil passages 10*a* adheres to inner walls of the oil passages 10*a* communicating with the pump lower chamber 15, which lubricating oil prevents the air from being unnecessarily sucked into the pump lower chamber 15 through the oil passages 10*a*.

Figure 10:
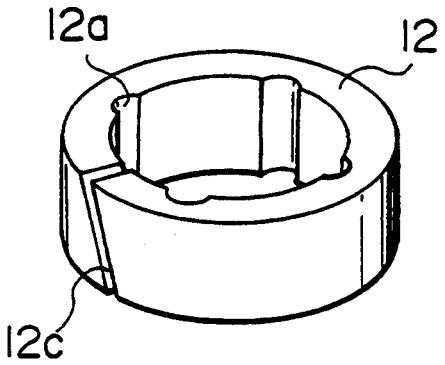
FIG. 10 is a perspective view showing a seal ring of a fluid pump which is a fifth embodiment according to the invention.
Figure 11:
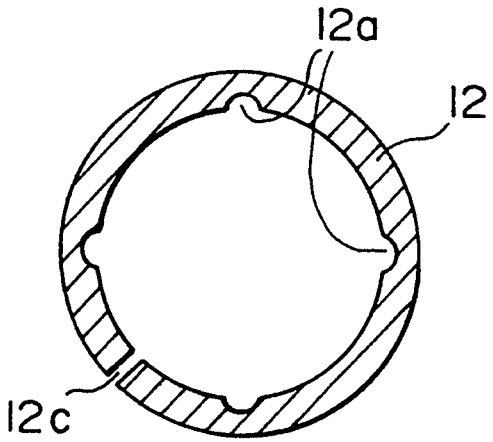
FIG. 11 is a horizontally cross-sectional view of the seal ring of FIG. 10.

A fifth embodiment according to the invention shown in FIGS. 10 to 11 is partially different from the third embodiment of FIG. 6. Only different portions of the fifth embodiment from the third embodiment will be described below.

In the third embodiment, because an inner diameter of the seal ring 12 is predetermined in such a manner that the seal ring is closely fitted on the piston rod 10, the seal ring 12 is strongly pressed against the outer peripheral surface of the piston rod due to a change of temperature. As a result, a sliding resistance at the movable portion of the piston rod becomes too strong, which causes unfavorable wear of the piston rod. The fifth embodiment aims to prevent the unfavorable wear of the piston rod.

In this fifth embodiment, as shown in FIGS. 10 to 11, a seal ring 12 is formed in a shape of a ring having cut ends. The ring 12 is cut at a portion of the circumference of the ring in the radial direction thereof. The cut ends 12*c* are inclined with respect to the axial direction of the ring. There is a minute gap between the cut end surfaces opposite to each other.

With the structure, the seal ring 12 contacts with an outer peripheral surface of a piston rod at a certain contact pressure by elasticity of an O-ring 13. When a volume of the ring 12 expands due to a rise of the temperature of the surroundings, the inner diameter of the ring is reduced in size. At this time, the gap between the cut ends 12*c* of the ring 12 is extended to prevent an increase of the contact pressure between the seal ring 12 and the outer peripheral surface of the piston rod 10 and to maintain the contact pressure at a certain value.

Moreover, when the seal ring 12 is to expand in the radial direction due to a reduction of the temperature, the dimensional expansion of the seal ring 12 is inhibited by the elasticity of the O-ring 13, so that the contact pressure of the seal ring 12 with respect to the outer peripheral surface of the piston rod 10 is kept at a certain value.

The gap between the cut ends 12c formed in the seal ring 12 has a function as an oil passage similarly to the oil passages 12a.

Figure 12:
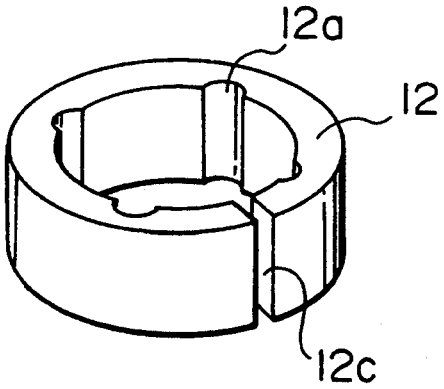
FIG. 12 is a perspective view of a seal ring according to the invention which is a modified example of the seal ring of FIG. 10.
Figure 13:
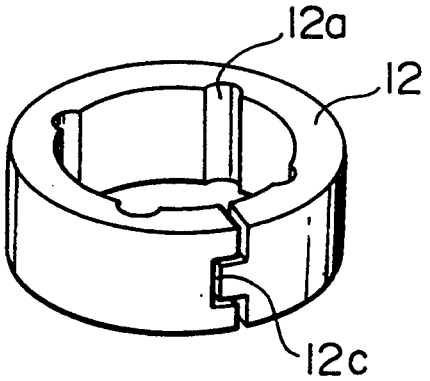
FIG. 13 is a perspective view of a seal ring according to the invention which is another modified example of the seal ring of FIG. 10.

The cut ends 12c of the seal ring 12 may extend along the axis of the ring, as shown in FIG. 12 which illustrates a modified example of the seal ring 12. Alternatively, the cut ends may be formed to have stepped portions, as illustrated in FIG. 13 of a modified example of the seal ring 12.

Figure 14:
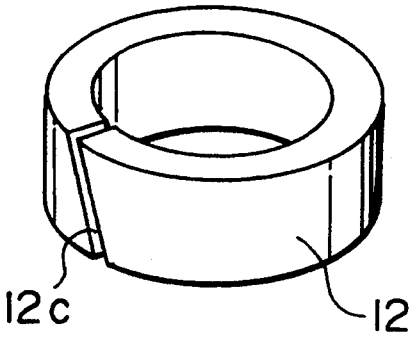
FIG. 14 is a perspective view of still another seal ring according to the invention.

Further, oil passages may be omitted from a seal ring having the cut ends 12c, as shown in FIG. 14.

Figure 15:
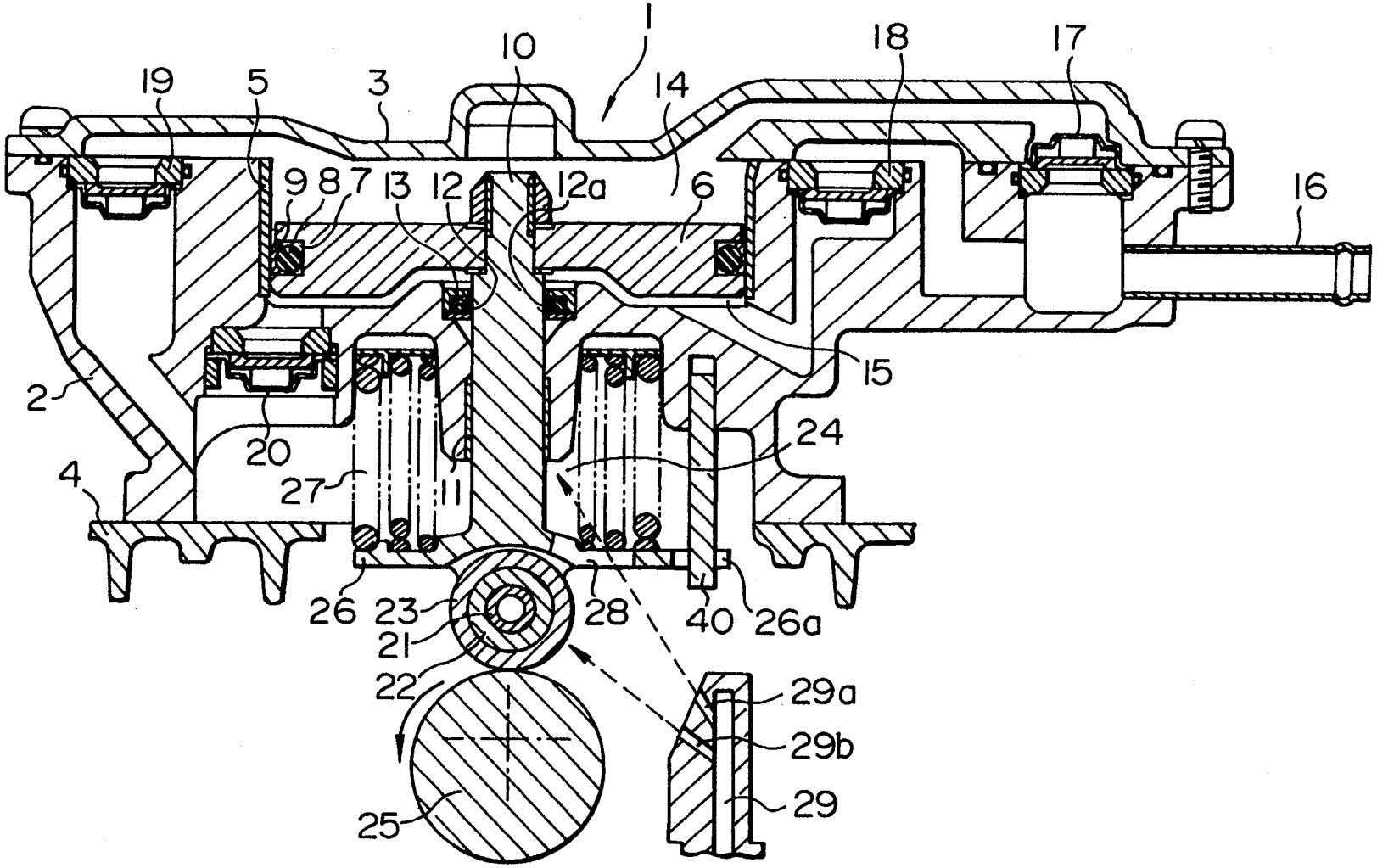
FIG. 15 is a longitudinally cross-sectional view of a sixth embodiment according to the invention.
Figure 16:
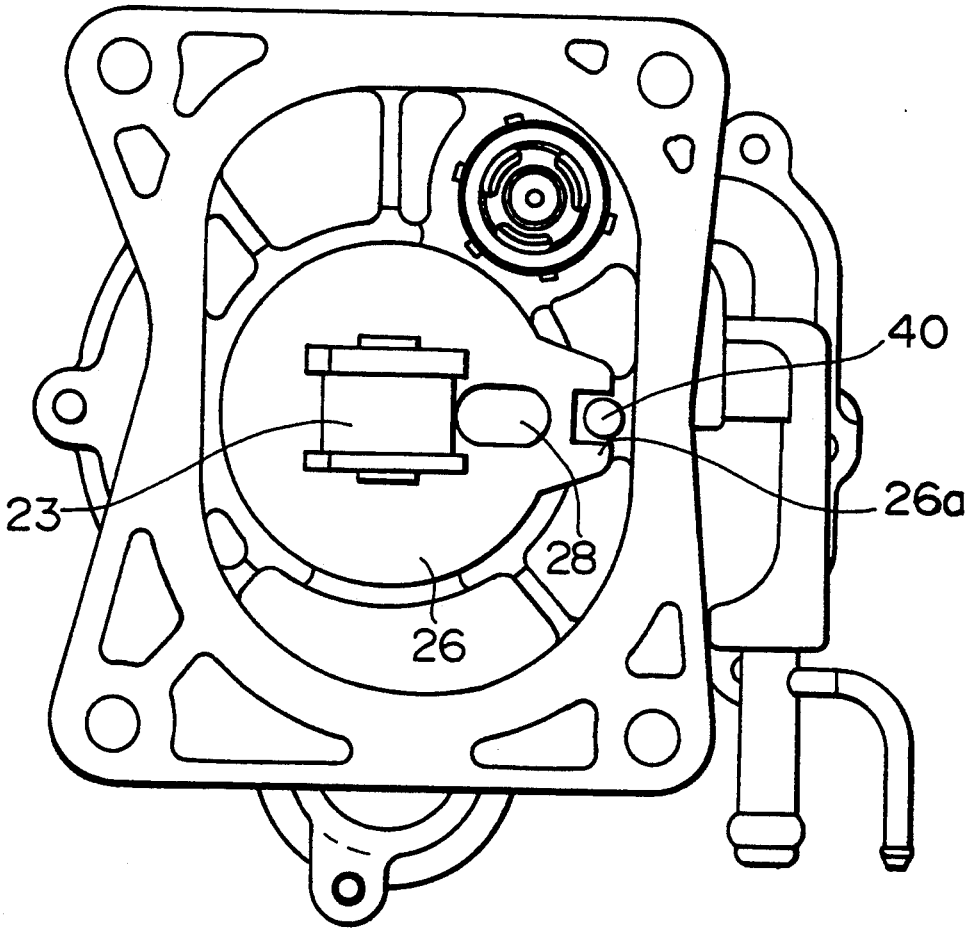
FIG. 16 is a bottom view of FIG. 15.

A sixth embodiment according to the invention shown in FIGS. 15 to 16 is partially different from the third embodiment of FIG. 6. Only different portions of the fifth embodiment from the third embodiment will be described below.

In a conventional reciprocating piston fluid pump, the lubricativity of a locking pin slidable portion which is an engagement portion between a locking pin for restraining rotation of a rod and the rod is insufficient so that seizure and wear occur in the locking pin slidable portion. As a result, the vertical reciprocating movement of the piston rod is not performed smoothly, and a stable pumping performance cannot be maintained over a long period of time. The sixth embodiment has advantages to solve such problems of the conventional pump.

In the sixth embodiment, as shown in FIGS. 15 to 16, a bar-like locking pin 40 is securely press-fitted in a lower casing 2 and suspended downwardly from the lower casing 2. A lower end of the locking pin 40 is loosely fitted in an engagement portion 26a provided on an outer periphery of a flange 26 of a piston rod 10.

A slidable portion between the engagement portion 26a and the locking pin 40, that is, between the piston rod 10 and the locking pin 40 is located in the radial direction of a cam 25, as clearly understood from FIGS. 15 and 16.

With such structure, lubricating oil sprayed from an oil nozzle 29a and supplied to a roller 23 which is a pump driving member, sticks to the cam 25 and it is dispersed owing to the centrifugal force of the cam so as to adhere to the slidable portion between the engagement portion 26a and the locking pin 40, thereby lubricating the engagement portion 26a and the locking pin 40.

In the reciprocating piston fluid pump according to the invention, because the lubricating oil can be supplied to the sliding surfaces of the piston ring and the cylinder, frictional force and heat caused by friction on the sliding surfaces are decreased, and wear and roughness of the sliding surfaces can be minimized.

The frictional force between the sliding surfaces of the piston ring and the cylinder is prevented from abnormally increasing. As a result, abnormalities of the pressure applied to a surface in contact with the cam and the pressing force of the bearing can be prevented, thereby restraining these portions from being unusually abraded.

Moreover, strokes of the piston can stably be maintained due to the prevention of the wear of the sliding surfaces of the piston ring and the cylinder, the reduction of the surface roughness, and the prevention of the abnormal wear of the cam contact portions. As a result, a stable pumping performance can be maintained over a long period of time.

In the reciprocating piston fluid pump having the above-described construction, because the lubricating oil is preferably supplied to the slidable portion between the piston rod and the locking pin, the seizure and wear of the slidable portion is eliminated so that the smooth reciprocating movement of the piston rod can be realized. Therefore, a stable pumping performance can be maintained over a long period of time.

As mentioned above, according to the invention, even if the seal ring expands owing to a temperature change, the contact pressure between the seal ring and the piston rod is not increased so that the wear of the seal ring and the piston rod resulting from an increase of the sliding resistance can be prevented.

Further, the gap between the cut ends acts as a passage for the lubricating oil. In the fluid pump in which the lubricating oil is supplied from the side of the driving member of the piston rod, the lubricating oil can be supplied to the piston portion provided on the other end of the piston rod. It is therefore possible to prevent the wear of the sliding surfaces of the piston and the cylinder.

Therefore, a stable pumping performance can be maintained over a long period of time.

What is claimed is:

1. A reciprocating piston fluid pump comprising:

a pump driving section including a cam operated by an engine and a roller driven by said cam, said roller being provided at a lower end of a piston rod;

a piston provided at an upper portion of said piston rod;

a pump chamber housing said piston and defined into a piston upper chamber and a piston lower chamber by said piston, said pump chamber including an opening at a central portion of said piston lower chamber, through which said piston rod extends;

a rod seal retainer portion provided between said piston rod and said opening of said pump chamber;

a spring for urging said piston rod downwardly;

oil passage means for communicating one of said pump upper chamber and said pump lower chamber with said bearing opening around said piston rod;

oil supply means for directly supplying lubricating oil to said pump driving section; and at least one communication hole provided between said pump driving section and said opening;

whereby centrifugal force of said roller enables lubricating oil supplied from said oil supply means to reach said opening through said communication hole.

2. A reciprocating piston fluid pump comprising:

a pump driving section including a cam operated by an engine and a roller driven by said cam, said roller being provided at a lower end of a piston rod;

a piston provided at an upper portion of said piston rod;

a pump chamber housing said piston and defined into a piston upper chamber and a piston lower chamber by said piston, said pump chamber including an opening at a central portion of said piston lower chamber, through which said piston rod extends;

a rod seal retainer portion provided between said piston rod and said opening of said pump chamber;

a spring for urging said piston rod downwardly;

oil passage means for communicating one of said pump upper chamber and said pump lower chamber with said opening around said piston rod; and oil supply means for directly supplying lubricating oil to said piston rod, said oil supply means having a nozzle of which an end is located in said opening and faces said piston rod.

3. A reciprocating piston fluid pump comprising:

a pump driving section including a cam operated by an engine and a roller driven by said cam, said roller being provided at a lower end of a piston rod;

a piston provided at an upper portion of said piston rod;

a pump chamber housing said piston and defined into a piston upper chamber and a piston lower chamber by said piston, said pump chamber including an opening at a central portion of said piston lower chamber, through which said piston rod extends;

a rod seal retainer portion provided between said piston rod and said opening of said pump chamber;

a spring for urging said piston rod downwardly;

oil passage means for communicating one of said pump upper chamber and said pump lower chamber with said opening around said piston rod;

oil supply means for supplying lubricating oil to said opening; and at least one communication hole provided between said opening and said oil supply means.

4. A reciprocating piston fluid pump according to claim 3, wherein a central portion of a lower surface of said piston is concaved upwardly, a central portion of a bottom of said pump lower chamber is convex upwardly, and said rod seal retainer portion is provided at a central portion of said convex portion.

5. A reciprocating piston fluid pump according to claim 4, wherein said oil passage means is provided in an oil ring of said rod seal retainer portion.

6. A reciprocating piston fluid pump according to claim 5, wherein said oil ring is formed in a shape of a ring having cut ends at a portion of the circumference of the ring.

7. A reciprocating piston fluid pump according to claim 4, wherein said oil passage means is provided on the piston rod.

8. A reciprocating piston fluid pump according to claim 7, wherein a seal ring of said rod retainer portion is formed in a shape of a ring having cut ends at a portion of the circumference of the ring.

9. A reciprocating piston fluid pump according to claim 4, wherein a slidable portion between said piston rod and a locking pin for restraining rotation of the piston rod is located in the radial direction of an engine cam for driving the pump.

10. A reciprocating piston fluid pump comprising:

a pump driving section including a cam operated by an engine and a roller driven by said cam, said roller being provided at a lower end of a piston rod;

a piston provided at an upper portion of said piston rod;

a pump chamber housing said piston and defined into a piston upper chamber and a piston lower chamber by said piston, said pump chamber including an opening at a central portion of said piston lower chamber, through which said piston rod extends;

a rod seal retainer portion provided between said piston rod and said opening of said pump chamber;

a spring for urging said piston rod downwardly;

oil passage means for communicating one of said pump upper chamber and said pump lower chamber with said opening around said piston rod; and oil supply means for directly supplying lubricating oil to said piston rod and to said pump driving section, said oil supply means having a nozzle of which an end is located in said opening and faces said piston rod and another nozzle of which an end faces said pump driving section.

* * * * *